US012584251B1

(12) United States Patent
Wei

(10) Patent No.: US 12,584,251 B1
(45) Date of Patent: Mar. 24, 2026

(54) MULTI-LAYER ELASTIC COMPOSITE FABRIC STRUCTURE

(71) Applicant: Ying-Pin Wei, Hsinchu County (TW)

(72) Inventor: Ying-Pin Wei, Hsinchu County (TW)

( * ) Notice: Subject to any disclaimer, the term of this patent is extended or adjusted under 35 U.S.C. 154(b) by 0 days.

(21) Appl. No.: 19/007,927

(22) Filed: Jan. 2, 2025

(30) Foreign Application Priority Data

Sep. 25, 2024 (TW) ..... 113136473

(51) Int. Cl.
*D04B 1/26* (2006.01)
*D01F 8/14* (2006.01)
*D04B 1/10* (2006.01)
*D04B 1/16* (2006.01)

(52) U.S. Cl.
CPC ..... *D04B 1/26* (2013.01); *D01F 8/14* (2013.01); *D04B 1/108* (2013.01); *D04B 1/16* (2013.01); *D10B 2331/04* (2013.01); *D10B 2501/043* (2013.01)

(58) Field of Classification Search
CPC .... D04B 1/26; D04B 1/265; D10B 2501/043; A41B 11/003; A41B 11/005; A41B 11/01; A41B 11/02; A41B 11/04; A41B 11/00
See application file for complete search history.

(56) References Cited

U.S. PATENT DOCUMENTS 5,653,128 A * 8/1997 Warren, Jr. ..... A41B 11/121 66/172 E
2007/0283483 A1* 12/2007 Jacober ..... D04B 1/265 66/178 R
2016/0165990 A1* 6/2016 Peterson ..... D06P 5/004 2/244
2016/0166419 A1* 6/2016 Jones ..... A43B 7/1445 602/66
2020/0146901 A1* 5/2020 Deguchi ..... A61F 13/085

FOREIGN PATENT DOCUMENTS

TW 202235480 A 9/2022
TW M660646 U 9/2024

OTHER PUBLICATIONS

Office Action of corresponding TW application 113136473, published on Jan. 6, 2025.

* cited by examiner

*Primary Examiner* — Khoa D Huynh
*Assistant Examiner* — Erick I Lopez
(74) *Attorney, Agent, or Firm* — Wang Law Firm, Inc.

(57) ABSTRACT

Provided is a multi-layer elastic composite fabric structure for addressing the issue of non-100% chemically recyclable in the existing fabric structures, including a cylindrical body including an opening section, an upper section, a turning section, a lower section, and a sealed section, the opening section is provided at one end of the body, with one end open and another end connected to the upper section; the sealed section is provided at another end of the body where the opening section is provided, and is connected to the lower section; the turning section is connected to the upper section at one end, and to the lower section at another end; the body includes a face yarn portion and a plating yarn portion located at outer and inner sides of the body, respectively, which are woven from an air-textured yarn made of polyester and a composite fiber made of polyester, respectively.

9 Claims, 3 Drawing Sheets

MULTI-LAYER ELASTIC COMPOSITE FABRIC STRUCTURE

CROSS-REFERENCE TO RELATED APPLICATION

This application claims the priority of Taiwanese patent application No. 113136473, filed on Sep. 25, 2024, which is incorporated herewith by reference.

BACKGROUND OF THE INVENTION

1. Field of the Invention

The present invention relates to a multi-layer elastic composite fabric structure, and in particular to a sock with a multi-layer elastic composite fabric structure.

2. The Prior Arts

As an indispensable wear in daily life, the design and material selection of socks directly influence the wearer's comfort as well as durability.

The structure of traditional socks typically consists of two layers of yarns, with the fiber of the outer layer referred to as the face yarn, and the fiber of the inner fiber referred to as the plating yarn. As the outer layer of a sock, the face yarn is responsible for the appearance design of the sock and the contact with the external environment; as the inner layer of the sock, the plating yarn is directly in contact with the wearer's skin and serves as the base layer of the sock.

Since socks come into contact with the external environments such as the ground or the inside of shoes during use, they should provide a certain level of anti-slip function. Therefore, in addition to using cotton, bamboo fiber, animal hair (wool) as raw materials of the face yarn, the face yarn may also be made of short-fiber materials of nylon, polyester fiber, spandex, etc., in combination with specific treatments, to achieve a better anti-slip effect.

In terms of material, the plating yarn is in contact with the human skin and provides functions such as comfort, perspiration absorption, breathability and elasticity, which is typically made of, for example, synthetic fibers (such as polyester fiber, nylon, spandex, Lycra) as raw materials.

To meet the comfort and functionality requirements, for most socks, the face yarn and the plating yarn are not made of single materials; in more cases, it tends to use composite materials for the face yarn and the plating yarn to optimize comfort and functionality. However, when a sock becomes aged or even damaged due to long-term use, the sock made of composite materials instead causes difficulties in recycling. As a result, in most cases, once the socks are aged or damaged, they can only be discarded but cannot be recycled and reused, which not only causes waste of resources, but also causes a burden on the environment.

In recent years, with the rise of environmental awareness in various countries, industrial production has gradually shifted towards the concept of "Cradle to Cradle", hoping to achieve the goal of starting from the source of production, using environmentally friendly and fully recyclable materials to produce eco-friendly products, and at the end of the product life cycle, taking recycling instead of discarding, thus achieving the goal of "environmental protection in production, environmental protection in use, and environmental protection after use".

For socks, in order to achieve the above goals, the primary challenge to be overcome is to use a single recyclable material to produce the entire sock as much as possible.

For example, compared with traditional sock made of a plurality of materials, when the entire sock is almost or completely made of polyester, there is no need to separate plurality of materials in the socks through additional procedures during the waste recycling stage, thereby can reduce the difficulty of recycling.

For socks, yarns made of long-fiber or short-fiber are generally used as the raw material of the face yarn. When the yarn is made of polyester, if a long-fiber structure is adopted, because the polyester long-fiber yarn generally lacks a fuzz structure, the surface of the yarn will be too smooth, leading to insufficient friction on the surface of the sock, thereby resulting in insufficient anti-slip ability, which is unsuitable as a raw material for the face yarn.

On the other hand, if a short-fiber polyester yarn is adopted, although it has a fuzz structure on the surface, the characteristics of the short-fiber yarn cause the fuzz to be easily shed during the friction between the sock and the environment, which will not only reduce the anti-slip performance, but also lead to pollution as the shed fuzz enters the environment, which goes against the original goal of environmental protection.

SUMMARY OF THE INVENTION

Problems to be Solved

The present invention aims to take the aforementioned "environmental protection in production, environmental protection in use, and environmental protection after use" as the goal, produce socks made of polyester as a main raw material, achieve the goal of near 100% chemically recycling, meanwhile, the face yarn woven from a long-fiber yarn made of polyester is used to produce the sock, such that it has a stable fuzz structure on the surface, thereby can provide sufficient friction, and does not lead to environmental pollution caused by the shed fuzz during use.

In order to solve the above problems, the present invention provides a multi-layer elastic composite fabric structure, which can be applied to small fabrics such as socks, gloves, hats, sleeves, underwear, sweaters, leggings, etc.

Technical Solution for the Problem

In an embodiment of the present invention, the fabric structure comprises: a body, which is a cylindrical structure, the body includes an opening section, an upper section, a turning section, a lower section, and a sealed section, wherein the opening section is provided at one end of the body, with one end of the opening section being open and another end of the opening section connected to the upper section; the sealed section is provided at another end of the body where the opening section is provided, and the sealed section has a seal at one end thereof, and is connected to the lower section at another end thereof; the turning section is connected to the upper section at one end thereof, and to the lower section at another end thereof; wherein the body includes a face yarn portion and a plating yarn portion, the face yarn portion is located at an outer side of the body, and the plating yarn portion is located at an inner side of the body.

In an embodiment of the present invention, the face yarn portion is woven from an air-textured yarn (ATY) manufactured by air entangling technology.

Here, ATY is a composite yarn manufactured by winding an outer filament made of polyethylene terephthalate (PET) around an outer surface of a composite elastic fiber (core filament) made of polyethylene terephthalate (PET) and polytrimethylene terephthalate fiber (PTT).

Wherein, the specification of the outer filament of the ATY can be represented as $X_1/Y_1$.

In such specification, $X_1$ indicates the fineness in Denier, which is a measurement to estimate the fineness of a fiber based on the weight of a certain length of the fiber, for example, $X_1$ of a fiber with a net weight of 1 gram per 9,000 meters is 1 denier; and $Y_1$ indicates the number of individual fibers, for example, when $Y_1$ is 144, it means that the fiber bundle is composed of 144 finer individual fibers.

In the present invention, $X_1$ is a positive integer between 45 and 150; and $Y_1$ is a positive integer between 72 and 288, for example, the $X_1/Y_1$ specification can be 50/72, 75/72, 50/144, 75/144, 50/288, 75/288,100/288 or 150/288, etc.

For example, the outer filament of ATY can be a DTY-processed filament with a specification of 50/144, a DTY-processed filament with a specification of 75/144, a SDY (Semi-Dull Yarn)/FDY (Full-Dull Yarn) raw filament with a specification of 50/144, or a FDY/SDY raw filament with a specification of 75/144.

On the other hand, the specification of the core filament of ATY can be represented as $X_2/Y_2$, where $X_2$ indicates the fineness in Denier; $Y_2$ indicates the number of individual fibers.

In the present invention, $X_2$ is a positive integer between 30 and 100; and $Y_2$ is a positive integer between 24 and 72.

For example, yarns with a specification of 30/24, 50/34, 50/36, 75/34, 75/36, 100/68 or 100/72 may be used as the core filament of the ATY, and its individual fiber is a SDY or FDY raw filament/processed filament formed by a composite elastic fiber of polyethylene terephthalate (PET) and polytrimethylene terephthalate fiber (PTT).

In other words, the ATY used in the present invention has a dual composite structure.

The advantage of using ATY is that the yarn made by the aforementioned air entangling technology has many loops (outer filament) of different shapes and sizes distributed on the surface thereof, which have properties similar to the fuzz of the short-fiber yarn. The yarn is a complex hybrid structure composed of multiple monofilaments that are intertwined, twisted and knotted with each other, giving the ATY cotton-like and wool-like characteristics. Therefore, using long fibers enables to provide a fuzz structure similar to that of short fibers.

In other words, using PET as the raw material of the outer filament of ATY in combination with using a core filament made of the composite material of PET and PTT enables to produce a long-fiber yarn with a fuzz structure and elasticity, the face yarn portion woven from such long-fiber yarn will be 100% chemically recyclable while providing both friction and anti-slip ability.

On the other hand, because the fuzz structure on the surface of the ATY fiber is quite delicate, even if the face yarn portion of the present invention contacts a slightly rough or sharp surface during use, it is not easily snagged, thereby reducing the possibility of damage to the face yarn portion.

In an embodiment of the present invention, an outer filament of ATY with a specification of 30/24, 50/34, 50/36, 75/34, 75/36, 100/68 or 100/72 can be adopted, but it is not limited thereto.

On the other hand, in an embodiment of the present invention, the plating yarn portion is made of an elastic fiber of a monofilament yarn produced by a thermoplastic polyester elastomer (TPEE) combined with a polyester fiber of DTY (Draw Textured Yarn).

DTY is a yarn with elasticity made from processed long-filament polyester fibers (pre-oriented yarns), which are continuously or simultaneously stretched on a texturing machine and deformed by a twisting machine. The purpose of using DTY is that after heat treatment, the polyester material in the the DTY yarn forms a spring-like structure and is combined with TPEE, thereby determining a maximum stretchable length, which has high stretchability, thereby giving the plating yarn portion good elasticity.

In an embodiment of the present invention, the yarn used in the plating yarn portion is formed by air-jet texturing and doubling a monofilament of TPEE of 20-100 denier (e.g., 40 denier) and a PET DTY processed fiber with a specification of 75/72, but it is not limited thereto.

In an embodiment of the present invention, a reinforcing structure is provided around a periphery of the opening section at one end, which provides enhanced stretchability and elasticity when the opening section is stretched open.

In an embodiment of the present invention, the turning section includes a thickened area having a thickness greater than that of the turning section, so as to improve durability when it contacts the environment and to provide buffer against external pressure.

In an embodiment of the present invention, a seam is provided between the sealed section and the lower section, the seam is sewn by a flat seam, a Roman seam, or a seamless method, etc.

In an embodiment of the present invention, the face yarn portion and the plating yarn section are added with one or more selected from silver ions, activated carbon particles, collagen, essential oil microcapsules, and nanoceramic particles.

In an embodiment of the present invention, the fabric structure is woven by using a circular knitting machine with a specification of a small cylinder (10-40 cm of diameter).

Advantages Over the Prior Art

Compared with the prior art, the multi-layer elastic composite fabric structure proposed by the present invention can achieve the following effects: 1. environmental protection in production, in which the entire fabric is made of polyester, and if a raw material of recycled polyester is adopted to produce the fabric structure, the goal of environmental protection can be achieved during the production stage; 2. environmental protection in use, in which on the premise of achieving sufficient friction, the ATY fiber has a firm fuzz structure that is not easily shed, which is environmentally friendly; 3. environmental protection after use, in which the fabric structure proposed by the present invention uses polyester fiber as the main material, and the entire fabric can be chemically recycled during the disposal stage, thereby achieving the environmental protection after use.

DETAILED DESCRIPTION OF THE PREFERRED EMBODIMENT

Figure 1:
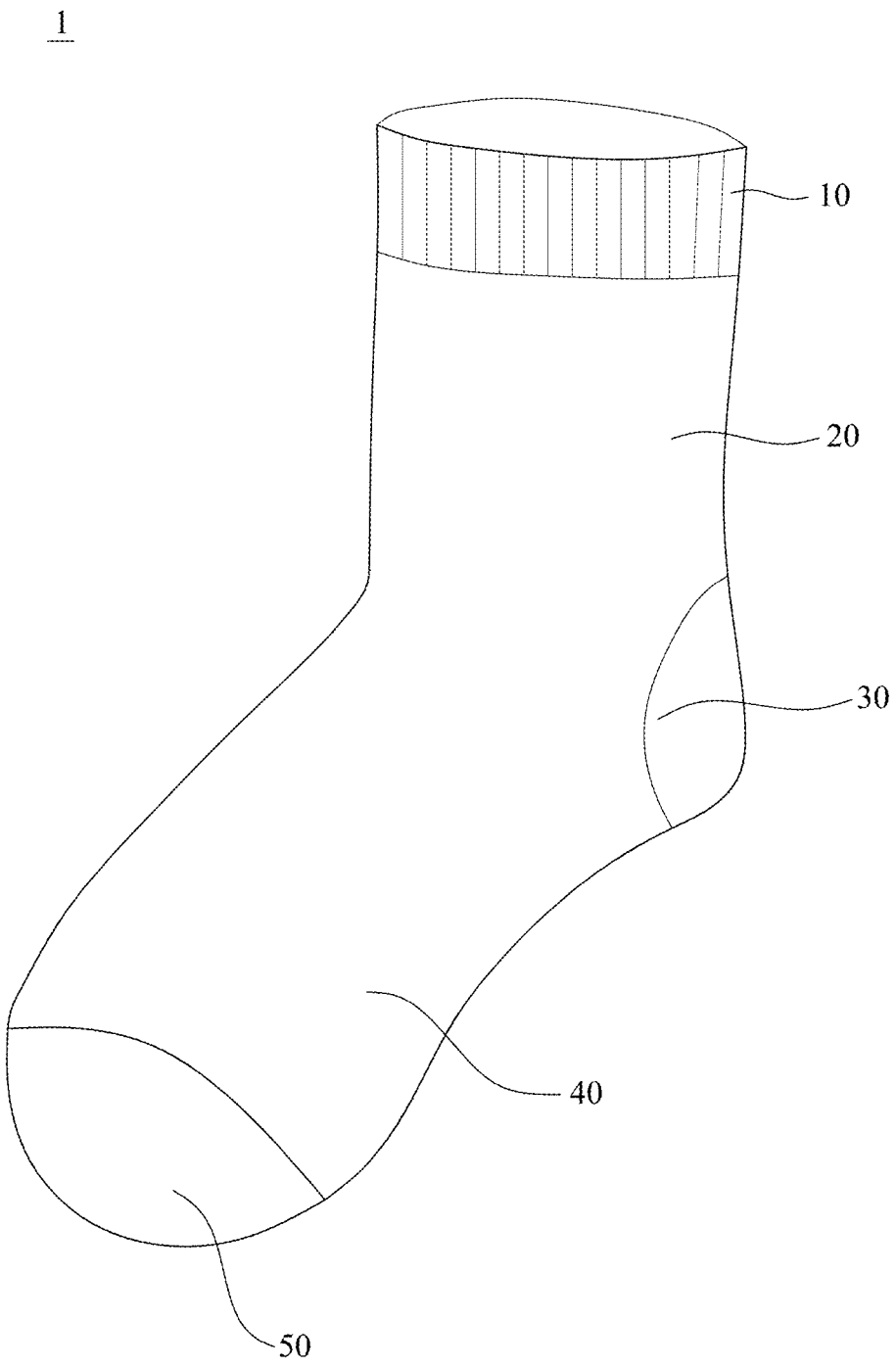
FIG. 1 is a schematic diagram of a first embodiment of the present invention.

Herein after, a further detailed description of the present invention is made with reference to drawings.

In order to avoid unnecessarily obscuring the technical meaning of the present invention, some details may be omitted in the drawings, and the depicted proportions in the drawings may be different from the actual proportions, but this does not hinder those skilled in the art from understanding the technical concept of the present invention.

Furthermore, in the drawings, the same reference numerals generally refer to the same elements.

FIG. 1 is a schematic diagram of a first embodiment of the present invention, which shows an aspect that the multilayer elastic composite fabric structure proposed by the present invention is implemented as a sock, comprising: a body 1, which is a cylindrical structure, the body 1 includes an opening section 10, an upper section 20, a turning section 30, a lower section 40, and a sealed section 50, wherein the opening section 10 is provided at one end of the body 1, with one end thereof being open and another end thereof connected to the upper section 20; the sealed section 50 is provided at another end of the body 1 where the opening section 10 is provided, and the sealed section 50 is connected to the lower section 40; and the turning section 30 is connected to the upper section 20 at one end thereof, and to the lower section 40 at another end thereof.

Figure 2:
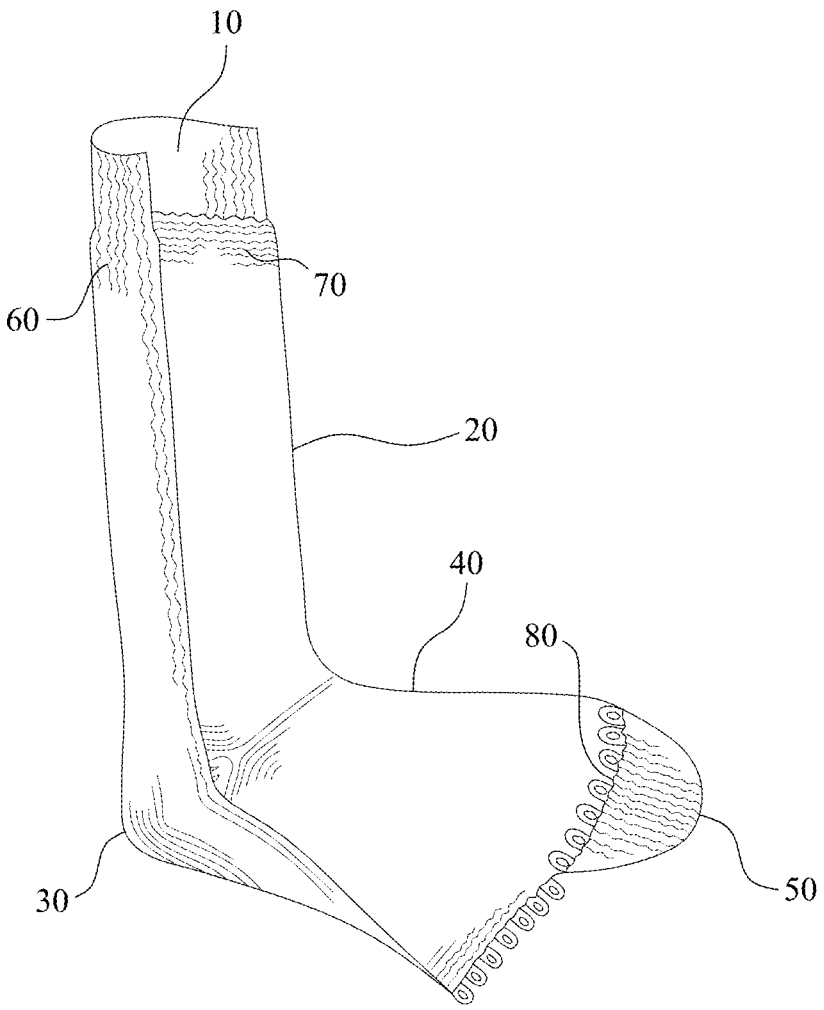
FIG. 2 is a cross-sectional view of the first embodiment of the present invention.

FIG. 2 is a cross-sectional view of the first embodiment of the present invention. The body 1 includes a face yarn portion 60 and a plating yarn portion 70, the face yarn portion 60 is located at an outer side of the body 1, and the plating yarn portion 70 is located at an inner side of the body 1. In addition, a seam 80 is provided between the sealed section 50 and the lower section 40.

The seam 80 can be sewn by a flat seam, a Roman seam, or a seamless method, but it is not limited thereto, those skilled in the art will understand that any technique that can be used for sewing in the art may be applied to the present invention.

In this embodiment, the face yarn portion 60 is woven from an air-textured yarn (ATY) manufactured by Air Entangling technology. The air-textured yarn was invented by DuPont in the United States, the principle is to use compressed gas as driving force to cause a long-filament of chemical fiber to undergo a series of physical changes such as loosening, displacement, entanglement and forming loop in a nozzle, thereby obtaining a textured yarn with a different structure from the raw filament.

The ATY fiber is structurally divided into an outer filament and a core filament, where the outer filament is the fiber of the outer layer, which is processed by air-jetting to form many fuzz and loops, thereby giving the fiber a fluffy feel and a hand feel similar to natural spun yarns. These fibers of the outer layer increase the breathability and softness of the fiber. The core filament is the fiber located inside, providing structural support and strength, maintaining the shape and elasticity of the fiber, and is the main body of the fiber.

The ATY is characterized in that the outer filament is processed by air-jetting to form fuzz and loops, which is a complex hybrid structure composed of multiple monofilaments that are intertwined, twisted and knotted with each other. These characteristics determine that it has excellent cotton-like and wool-like performance, the processed textured yarn combines the performances of both long-filaments and short-fiber yarns, offering strong wool-like feel, good hand feel, and better coverage than the short-fiber yarns.

Figure 3:
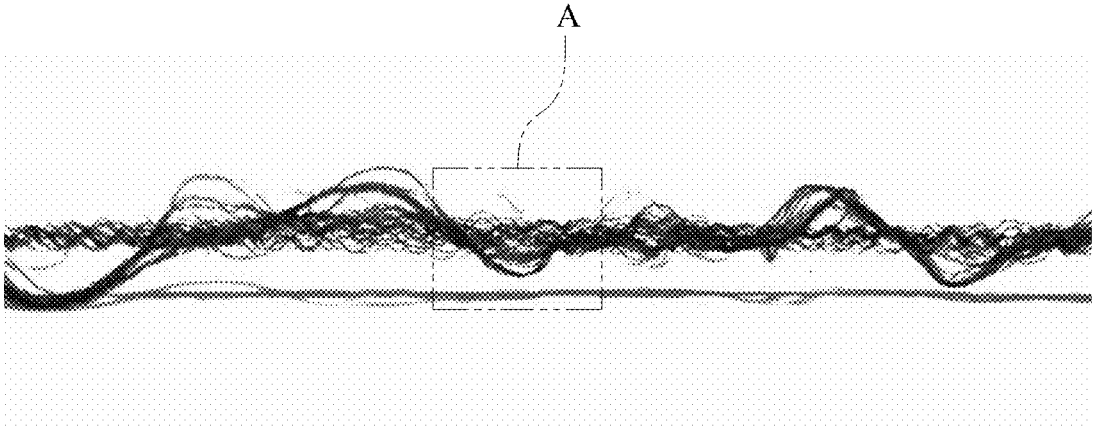
FIG. 3 is a structural diagram of an ATY fiber of an actual product of the present invention.
Figure 4:
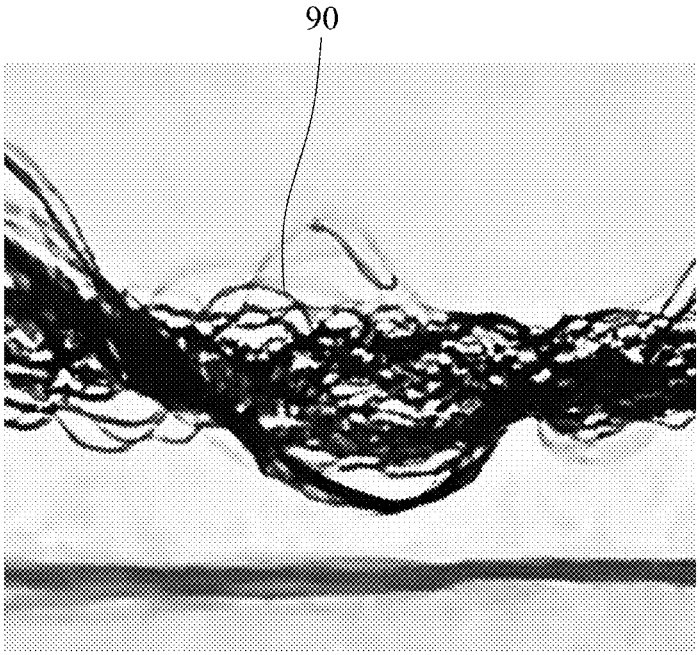
FIG. 4 is an enlarged view of an area A in FIG. 3.

FIG. 3 is a structural diagram of the ATY fiber of an actual product of the present invention, which shows the structure of the ATY fiber, and FIG. 4 is a partial enlarged view of an area A in FIG. 3, which further shows the fuzz structure in the ATY fiber.

It can be seen from FIGS. 3 and 4 that there are a plurality of mutually intertwined loops of different sizes on the surface of the ATY fiber, that is, fuzz 90. The fuzz 90 gives the ATY fiber a unique touch, making the touch of the fabric different from a traditional polyester fiber, and providing a touch similar to cotton or animal hair.

In addition, the fuzz 90 provides a considerable level of friction when it contacts the environment (e.g., the ground), and such friction gives the fabric structure of the present invention an anti-slip effect. Especially when the fabric structure of the present invention is provided in the form of socks, the fuzz 90 gives the face yarn portion 60 of the sock sufficient anti-slip ability, to prevent the user from slipping while walking.

Because the fuzz structure on the surface of the ATY fiber is quite delicate, even if the face yarn portion of the present invention contacts a slightly rough or sharp surface during use, it is not easily snagged, thereby reducing the possibility of damage to the face yarn portion.

In order to create a fuzz structure with polyester fiber, in addition to using the long-fiber structure of the ATY fiber, the traditional method typically uses a short-fiber yarn. However, when the polyester fiber is formed into a short-fiber type, although it has a fuzz structure, only one end of the fuzz structure is attached to the main filament, making it easier to be shed than the fuzz structure of the ATY polyester fiber.

In contrast, using a polyester as the raw material of the ATY fiber allows the production of long-fiber yarns with fuzz structures, compared with the traditional short-fiber polyester yarn, since both ends of the loop of the fuzz structure of the ATY polyester fiber are attached to the surface of the main filament, the firmness of the fuzz is significantly enhanced, such that on the premise that the fiber provides a considerable level of friction, the overall service life can also be extend.

In this embodiment, PET can be used as the polyester raw material of the outer filament of ATY, but it is not limited thereto, those skilled in the art will understand that any polyester material compatible with the ATY process may be applied to the present invention without departing from the technical concept of the present invention.

For example, the ATY fiber can also adopt the following as the raw material of the outer filament: PBT (polybutylene terephthalate), which has better flexibility and heat resistance and is commonly used in sportswear and tights; PEN (polyethylene naphthalate), which has higher strength and heat resistance than PET and is suitable for industrial applications; and PLA (polylactic acid), which is a bio-based polyester material, and is biodegradable and environmentally friendly.

In terms of the core filament of the ATY fiber, the present invention uses a core filament made of a composite material of PET and PTT, which is a fiber with high performance that has been stretched and heat-set, and thus has elasticity and wrinkle resistance, and gives a fluffy and full appearance. Its soft hand feel, good moisture absorption and perspiration functions make it an ideal material for a variety of textiles such as sportswear, underwear, and bedding. The DTY fiber not only has high strength, but also provides long-term durability while maintaining comfort, thus has a wide range of applications.

In this embodiment, polytrimethylene terephthalate fiber (PTT) can be used as the core filament of ATY, but it is not limited thereto, those skilled in the art will understand that any polyester material compatible with the ATY process may be applied to the present invention without departing from the technical concept of the present invention.

For example, other available polyester raw materials include: PET (polyethylene terephthalate), which is the most common polyester fiber and has high strength and abrasion resistance; PBT (polybutylene terephthalate), which has higher flexibility and heat resistance, and is suitable for elastic products; and PEN (polyethylene naphthalate), which has higher strength and heat resistance and is suitable for industrial use.

In other words, using PET as the raw material of the outer filament of ATY in combination with using a core filament made of the composite material of PET/PTT enables to produce a long-fiber yarn with a fuzz structure and elasticity, the face yarn portion woven from such long-fiber yarn will be chemically recyclable while providing both friction and anti-slip ability.

In an embodiment of the present invention, an outer filament of ATY with a specification of 50/72, 75/72, 50/144, 75/144, 50/288, 75/288,100/288, or 150/288 can be adopted; a core filament of ATY with a specification of 30/24, 50/34, 50/36, 75/34, 75/36, 100/68 or 100/72 can be adopted, but it is not limited thereto.

In an embodiment of the present invention, the plating yarn portion adopts an elastic fiber formed by air-jet texturing and doubling a monofilament of TPEE of 20-100 denier (e.g., 40 denier) and a PET 75/72 DTY processed filament, but it is not limited thereto.

In addition, in order to give more functionality to the fabric of the present invention, the face yarn portion 60 and the plating yarn portion 70 can be added with various functional components, such as one or more of silver ions, activated carbon particles, collagen, essential oil microcapsules, and nanoceramic particles.

Wherein, the activated carbon particles have moisture-absorbing and deodorizing functions, and are commonly used in sports socks or anti-odor socks; the collagen can be added to moisturize and protect the skin, making it suitable for comfortable socks for long-term wear; the essential oil microcapsules can emit fragrance and have soothing and anti-stress effects; and the nanoceramic particles can improve the warmth and durability of socks.

However, the present invention is not limited thereto, those skilled in the art will understand that any functional components that can be used in the fiber may be added to the face yarn portion 60 and the plating yarn portion 70 of the present invention without departing from the technical concept of the present invention.

A test (Report No. TX80642A/2024/SP), issued on Aug. 14, 2024 from SGS Inspection agency, was conducted for the actual components of the product when the present invention is implemented as a sock. The report indicates that the fiber composition of the product includes 92.8% of polyester fiber and 7.2% of other fibers having elastic characteristics (analyzed in accordance with American Association of Textile Chemists and Colorists AATCC 20:2021 using a Fourier transform infrared (FTIR) spectrometer (VARIAN 3100)). This result demonstrates that the main component of the product is polyester. As for the aforementioned "other fibers", their main component was identified as polyester through analysis using a Fourier transform infrared spectrometer.

In other words, the fabric structure proposed by the present invention enables the production of a fabric made of 100% polyester; furthermore, the chemically recyclable nature of the polyester materials allows the entire fabric structure to be chemically recycled and reused at the end of its life cycle, and then used in subsequent production processes of fabrics.

In addition, the ATY fiber used in the face yarn portion of the present invention has a long-fiber structure with fuzz, the fuzz can provide sufficient friction and is not easily shed during use.

In summary, compared with existing fabric structures, the present invention solves the issue of non-100% chemically recyclable and reusable in the existing fabric structures, and achieves the goal of "environmental protection in production, environmental protection in use, and environmental protection after use".

The above are merely embodiments exemplified in the present disclosure, and the present invention is not limited thereto, those skilled in the art will understand that any combination, adaptation, substitution and modification to the present invention should still fall within the technical concept of the present invention without departing from it.

What is claimed is:

1. A multi-layer elastic composite fabric structure, comprising:

a body, which is a cylindrical structure, the body includes an opening section, an upper section, a turning section, a lower section, and a sealed section, wherein the opening section is provided at one end of the body, with one end of the opening section being open and another end of the opening section connected to the upper section;

the sealed section is provided at another end of the body where the opening section is provided, and the sealed section is connected to the lower section;

the turning section is connected to the upper section at one end thereof, and to the lower section at another end thereof;

wherein the body includes a face yarn portion and a plating yarn portion, the face yarn portion is located at an outer side of the body, and the plating yarn portion is located at an inner side of the body, and the face yarn portion is woven from an air-textured yarn (ATY) made of polyester, and the plating yarn portion is woven from a composite fiber made of polyester; wherein the air-textured yarn is a composite yarn manufactured by winding an outer filament around an outer surface of a core filament, wherein the outer filament is made of polyethylene terephthalate (PET);

the core filament is a composite material of polyethylene terephthalate (PET) and polytrimethylene terephthalate fiber (PTT); and the plating yarn portion is made of a composite fiber of a monofilament of a thermoplastic elastomer (TPEE) and a draw textured yarn (DTY) of polyester.

2. The multi-layer elastic composite fabric structure according to claim 1, wherein the outer filament of the air-textured yarn has an $X_1/Y_1$ specification, where $X_1$ is a positive integer between 45 and 150 and $Y_1$ is a positive integer between 72 and 288;

the core filament of the air-textured yarn has an $X_2/Y_2$ specification, where $X_2$ is a positive integer between 30 and 100 and $Y_2$ is a positive integer between 24 and 72.

3. The multi-layer elastic composite fabric structure according to claim 2, wherein the specification of the outer filament of the air-textured yarn is 50/72, 75/72, 50/144, 75/144, 50/288, 75/288, 100/288 or 150/288; the specification of the core filament of the air-textured yarn is 30/24, 50/34, 50/36, 75/34, 75/36, 100/68 or 100/72; and in the plating yarn portion, a raw filament of the thermoplastic elastomer is a monofilament of 20-100 denier, and the draw textured yarn has a specification of 75/72.

4. The multi-layer elastic composite fabric structure according to claim 3, wherein a surface of the air-textured yarn has a plurality of fuzz structures.

5. The multi-layer elastic composite fabric structure according to claim 3, wherein a seam is provided between the sealed section and the lower section.

6. The multi-layer elastic composite fabric structure according to claim 5, wherein the seam is sewn by a flat seam, a Roman seam, or a seamless method.

7. The multi-layer elastic composite fabric structure according to claim 3, wherein an overall thickness of the turning section is greater than that of the upper section and the lower section.

8. The multi-layer elastic composite fabric structure according to claim 1, wherein a reinforcing structure is provided around a periphery of the opening section, which provides enhanced stretchability and elasticity.

9. The multi-layer elastic composite fabric structure according to claim 1, wherein the face yarn portion and the plating yarn portion are added with one or more selected from silver ions, activated carbon particles, collagen, essential oil microcapsules, and nanoceramic particles.

* * * * *